US005382867A

United States Patent [19]

Maruo et al.

[11] Patent Number: 5,382,867

[45] Date of Patent: Jan. 17, 1995

[54] FIELD-EMISSION TYPE ELECTRONIC DEVICE

[75] Inventors: Yuji Maruo, Abiko; Yutaka Akagi, Kashiwa; Tomokazu Ise, Abiko; Masao Urayama, Misato, all of Japan

[73] Assignee: Sharp Kabushiki Kaisha, Osaka, Japan

[21] Appl. No.: 954,396

[22] Filed: Sep. 30, 1992

[30] Foreign Application Priority Data

| | | | |
|---|---|---|---|
| Oct. 2, 1991 | [JP] | Japan | 3-255240 |
| Dec. 3, 1991 | [JP] | Japan | 3-319251 |
| Sep. 3, 1992 | [JP] | Japan | 4-235597 |

[51] Int. Cl.[6] ..... H01J 1/02

[52] U.S. Cl. ..... 313/309; 445/24

[58] Field of Search ..... 313/307, 309, 336, 351, 313/310; 445/24, 50, 51

[56] References Cited

U.S. PATENT DOCUMENTS

| | | | |
|---|---|---|---|
| 4,578,614 | 3/1986 | Gray et al. | 313/307 |
| 4,956,574 | 9/1990 | Kane | 313/307 |
| 5,038,070 | 8/1991 | Bardai et al. | 313/309 |
| 5,148,078 | 9/1992 | Kane | 313/309 |
| 5,148,079 | 9/1992 | Kado et al. | 313/309 |
| 5,192,240 | 3/1993 | Komatsu | 445/24 |

FOREIGN PATENT DOCUMENTS

| | | |
|---|---|---|
| 0354750A2 | 2/1990 | European Pat. Off. . |
| 0406886A2 | 1/1991 | European Pat. Off. . |
| 0443865A1 | 8/1991 | European Pat. Off. . |

OTHER PUBLICATIONS

J. Itoh et al., "Metal-Film-Edge Field Emitter Array With A Self-Aligned Gate", Technical Digest of IVMC 91, Nagahama Japan, 1991, pp. 46–47.

H. Komatsu, "Fabrication and Characteristics of Vacuum Microelectronic Devices With a Lateral Field Electron Cathode", Technical Digest of IVMC 91, Nagahama Japan, 1991, pp. 48–49.

A. Kaneko et al., "Field Emitter Array With Lateral Wedges", Technical Digest of IVMC 91, Nagahama Japan, 1991, pp. 50–51.

J. Itoh et al., "Lateral Triode With Metal-Film-Edge Field Emitter Array", Technical Digest of IVMC 91, Nagahama Japan, 1991, pp. 158–159.

*Primary Examiner*—Alvin E. Oberley
*Assistant Examiner*—Stevan J. Saras
*Attorney, Agent, or Firm*—David G. Conlin; Robert F. O'Connell

[57] ABSTRACT

A field-emission electronic device works as a field-emission electron source. The field-emission electronic device comprises an anode electrode, a first insulating member disposed on the anode electrode, a cathode electrode disposed on the first insulating member, a second insulating member disposed on the anode electrode at a distance from the first insulating member, and a gate electrode disposed on the second insulating member. Therefore, the field-emission electronic device can be formed to make the distance between the electrodes smaller than that of the known field-emission electronic device. Concretely, the distances between the cathode electrode and the gate electrode and between the cathode electrode and the anode electrode are allowed to be reduced. This results in lowering a gate voltage and an anode voltage.

22 Claims, 13 Drawing Sheets

FIELD-EMISSION TYPE ELECTRONIC DEVICE

BACKGROUND OF THE INVENTION

1. Field of the Invention

The present invention relates to a field-emission type electronic device containing an electron source which is operated to emit electrons on the principle of field emission, and more particularly to a cold cathode provided in the field-emission type electronic source.

2. Description of the Related Art

In recent days, a remarkable progress has been made about a technique for manufacturing the field-emission type electronic device for emitting electrons in a high electric field in vacuum as a result of developing a fining technique utilized in the field of an integrated circuit or thin film deposition. In particular, a field-emission type cold cathode having a quite fine structure has been manufactured. This type of field-emission type cold cathode is the most fundamental electron-emission device included in the essential parts of a micro electronic tube or electron gun.

The field-emission type electronic device or the field-emission type electron source containing a lot of electron-emission devices has been invented for an essential component for a micro triode or a thin display element, for example. The operation and the manufacturing method of the field-emission type electronic device or the field-emission type electron source have been known in the technical report: C. A. Spindt, et. of Stanford Research Institute, pp. 5248 to 5263, Vol. 47, December (1976) of Journal of Applied Physics. Further, they have been disclosed in U.S. Pat. Nos. 4,307,507 and 4,513,308 invented by H. F. Gray, et.

Then, some of the related arts will be described later.

In a conventional field-emission electron source, a substrate electrode is formed of monocrystalline silicon having low resistance in order to keep compatibility with a fining technique in the field of an integrated circuit or thin film deposition, lower the cost, and make it monolithic. On the substrate electrode, a lot of conical cold cathode chip are formed. Each cold cathode chip is made of the same monocrystalline silicon as the substrate electrode or a high melting point metal such as tungsten (W) or molybdenum (Mo). An insulating layer is formed on the substrate electrode around the cold cathode chip. On the insulating layer, a gate electrode is deposited. An anode electrode is provided to cover those cold cathode chips and the gate electrode as keeping vacuum space between the anode electrode and the side of the cold cathode chips and the gate electrode.

In such a electron source, a voltage of about 100 to 200 V is applied as a gate voltage between each cold cathode chip and the gate electrode. The application results in causing a strong electric field of about $10^7$ V/cm between each cold cathode chip and the gate electrode, thereby allowing each cold cathode chip to emit electrons on the field-emission principle. The anode voltage of 300 to 500 V applied to the anode electrode causes emitted electrons to reach the anode electrode.

In the current techniques, the critical diameter of the conical cold cathode chip is about 1 μm and the critical height thereof is about 1 μm. Further, it is practically impossible to avoid variable electron-emission characteristics in those chips caused by the variations of the cold cathode chips. To overcome the disadvantageous matter, the anode electrode is made of a transparent material and a fluorescent material is coated on the transparent anode electrode. A trial is now being made for a thin display unit using the cold cathode chips as electron-emission sources only. In a case that this type of field-emission electronic device applies to the thin display unit, it is unnecessary to accurately control the emitted electrons. Hence, 1000 or more electron-emission cold cathode chips, which are arranged per one pixel in an array manner, are driven in parallel for the purpose of averaging the variation of the electron-emission cold cathode chips and obtaining the necessary amount of emitted electrons.

In a case that the field-emission cold cathode chips are used for a micro triode, the resulting triode may break the shortcomings and the limits entailed in the solid device such as a semiconductor device. The solid device has such a limit that the saturated traveling speed of electrons in the solid device is about c/1000 (c is a light speed). On the other hand, in the field-emission electronic device, the emitted electrons travel in vacuum. Hence, the traveling speed of the electrons may be faster than the traveling speed of the electrons in the solid device by one or more digits. Further, the field-emission electronic device is more endurable in high temperature and radioactive rays. For example, in a case that a voltage of 50 V is applied between the electrodes keeping a spacing of 1 μm therebetween, the traveling speed of electrons is $2\times10^8$ cm/s on average and the traveling time for a distance of 1 μm is 0.5 psec.

The use of the triode having dimensions on submicron order, therefore, makes it possible to realize a super high-speed device having a response speed on tera-hertz level.

In the known field-emission type electron source, a field-emission type cold cathode chip is formed like a conical form on a substrate electrode made of a metal or semiconductor material as mentioned above. An insulating layer is formed to cover the substrate electrode around the field-emission type cold cathode. On the insulating layer, a gate electrode is deposited. When a voltage is applied between the field-emission type cold cathode and the gate electrode, a high electric field takes place between the cold cathode and the gate electrode so that electrons can be emitted from the field-emission cold cathode on the basis of the field-emission principle.

The field-emission cold cathode is made of silicon or metal such as tungsten (W) or molybdenum (Mo). Further trial is now being made for optimizing the form of the field-emission cold cathode in order to reduce an operating voltage on which electrons are emitted.

In another conventional field-emission electron source, like the foregoing composition, a field-emission cold cathode is formed like a conical form on a substrate electrode. An insulating layer is formed on the substrate electrode around the field-emission cold cathode. On the insulating layer, a gate electrode is deposited. The substrate electrode is made of semiconductor or metal. Unlike the foregoing composition, the substrate electrode is projected like a pyramid at the site where the conical field-emission cold cathode is to be formed. On the pyramid portion, a coating layer is deposited. The coating layer is made of a material having a low work function such as cesium (Cs) or lanthanum hexabolaide (LAB6). It means that the pyramid portion of the substrate electrode and the coating layer deposited thereon compose the field-emission cold cathode.

Next, the shortcomings of the conventional compositions will be described.

For the known field-emission electric devices, the following shortcomings take place. Since the distance between the cold cathode chip served as a cathode electrode and the gate electrode is not made so small, it is necessary to apply a large voltage between the cathode electrode and the gate electrode for obtaining the necessary electric field to allowing the tip of the cold cathode chip to emit electrons. Further, since the distance between the cathode electrode and the anode electrode is made larger, it needs a considerable time to travel electrons between the cathode electrode and the anode electrode.

The cold cathode chip has a cut-off frequency $f_T$ represented by the express ion:

$$f_T = g_m/(2\pi C_{gc})$$

wherein $g_m$ is a mutual conductance and $C_{gc}$ is a capacitance between the gate electrode and the cathode electrode.

To realize a cold cathode chip enabling to operate at high speed, therefore, it is necessary to increase the mutual conductance $g_m$ but decrease the capacitance $C_{gc}$. However, in the structure of the known field-emission electronic devices, the electron emission is made possible only at the tip of the cold cathode chip. Further, since it is difficult to make the spacing between the adjacent cold cathode chips small in light of the manufacturing technique, the area where electrons are emitted and the amount of emitted electrons are both small. Hence, it is difficult to increase the mutual conductance $g_m$ of the electronic device depending on the current density of the field emission. Further, the field-emission electronic devices has the structure where the gate electrode layer is opposed to the cathode electrode layer as keeping the insulating layer therebetween. The structure inevitably increases the value of the capacitance $C_{gc}$ between the gate electrode and the cathode electrode.

In turn, for the first conventional field-emission electron source, in a case that the field-emission cold cathode is made of a high melting point metal such as tungsten (W), molybdenum (Mo) or titanium (Ti), those metals are thermally endurable and mechanically strong, but have so high work functions. For example, the work function of tungsten is about 4.3 eV and one of molybdenum is about 4.2 eV. They disadvantageously need high operating voltages.

For the second known composition of a field-emission electron source as mentioned above, the work function of the coating layer is so low such as about 2.1 eV in case of using cesium (Cs) and about 2.7 eV in case of using lanthanum hexabolaid ($LaB_6$). Hence, the operating voltage is made smaller. The difference of thermal expansion coefficient between the material of the coating layer and the material of the substrate electrode causes the resulting cold cathode to be thermally unstable and mechanically weak. Since the material of the coating layer is chemically active, a shortcoming takes place that the work function is subject to change. Additional, since the material of the coating layer such as selenium has a far larger than the substrate electrode made of metal or semiconductor, the electric conduction between both is made worse, so that the electron emission is difficult to take place.

SUMMARY OF THE INVENTION

It is therefore an object of the present invention to provide a field-emission electronic device which is capable of realizing high-speed operation.

It is another object of the invention to provide a field-emission electron source which is physically stable and excellent in electric and mechanical characteristics and has a low work function.

The first object of the invention can be achieved by a field-emission electronic device comprising an anode electrode, a first insulating member disposed on the anode electrode, a cathode electrode disposed on the first insulating member, a second insulating member disposed on the anode electrode at a distance from the first insulating member, and a gate electrode disposed on the second insulating member.

A field-emission electronic device according to another aspect of the invention includes a substrate, a first insulating member disposed on the substrate, a cathode electrode disposed on the first insulating member, a second insulating member disposed on the substrate at a distance from the first insulating member, a gate electrode disposed on the second insulating member, and an anode electrode disposed between the first insulating member and the second insulating member and electrically connected with the substrate.

The field-emission electronic device according to this invention is formed to make the distance between the electrodes smaller than that of the known field-emission electronic device. Concretely, the distances between the cathode electrode and the gate electrode and between the cathode electrode and the anode electrode are allowed to be reduced. This results in lowering a gate voltage and an anode voltage. In the structure of this invention as described above, the value of the capacitance between the cathode electrode and the gate electrode can be made smaller as compared to the known field-emission electronic device wherein the cathode electrode and the gate electrode are laminated with the insulating layer laid therebetween. In a case that the anode electrode is provided on the substrate located between the cathode electrode and the gate electrode, the values of capacitance caused between the cathode electrode and the anode electrode and between the gate electrode and the anode electrode can be reduced.

For example, if a voltage of 20 V to 100 V is applied between the cathode electrode and the gate electrode, a strong electric field of about $10^7$ V/cm takes place between the tip of the cathode electrode and the gate electrode in quick response to the application of the voltage. The cold cathode tip serves to emit electrons at its upper tip on the basis of the field-emission principle.

In carrying out the second object, a field-emission electronic device comprises a substrate, and a field-emission cold cathode, which is formed of metallic carbide, metallic nitride, metallic oxide or metallic boride, disposed on and electrically connected with the substrate electrode, a composition ratio of carbon, nitrogen, oxygen or boron of the cathode being gradually increased from a bottom portion thereof adjacent to the substrate to a top portion thereof.

The field-emission cold cathode is formed of metallic carbide, metallic nitride, metallic oxide or metallic boride. The work function of such a material is smaller than that of the metal used in the related art such as molybdenum (Mo) or titanium (Ti). This results in being able to reduce the operating voltage on which electrons are emitted. Moreover, the field-emission cold cathode may have a deposition structure wherein the composition ratio of carbon, nitrogen, oxygen or baron is progressively increased from the substrate (base of the conical form) to the tip (of the conical form). In the structure, since the electric resistance is continuously changed from the substrate electrode to the tip, the electric conductivity in the cold cathode is improved as compared to the structure where the hold cathode coating layer is directly deposited on the substrate electrode. As another advantage, it is possible to suppress the difference of a thermal expansion coefficient between the layers and improve the bonding strength between the cold cathode and the substrate electrode and the thermal stability of them. The present invention can thus offer a field-emission electron source which is physically stable and is excellent in electric and mechanical characteristics.

Further objects and advantages of the present invention, will be apparent from the following description of the preferred embodiments of the invention as illustrated in the accompanying drawings.

BRIEF DESCRIPTION THE DRAWINGS

Figure 2:
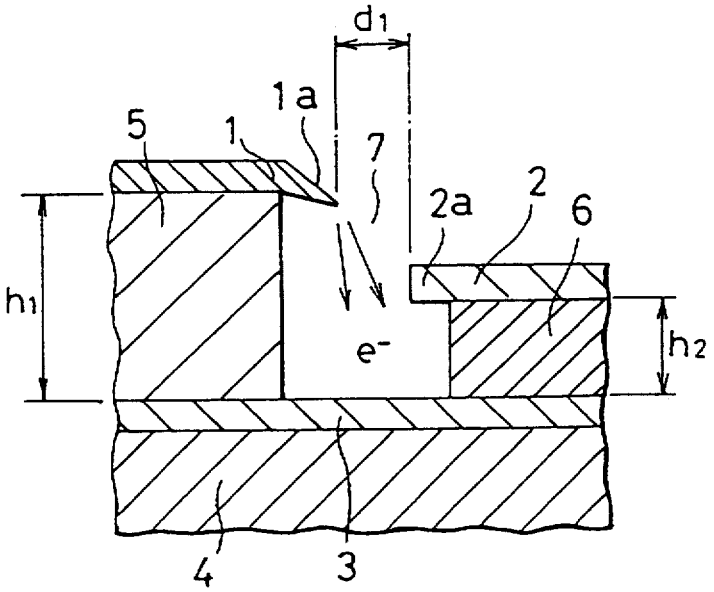
FIG. 2 is a sectional view cut on the line II—II of FIG. 1.
Figure 13:
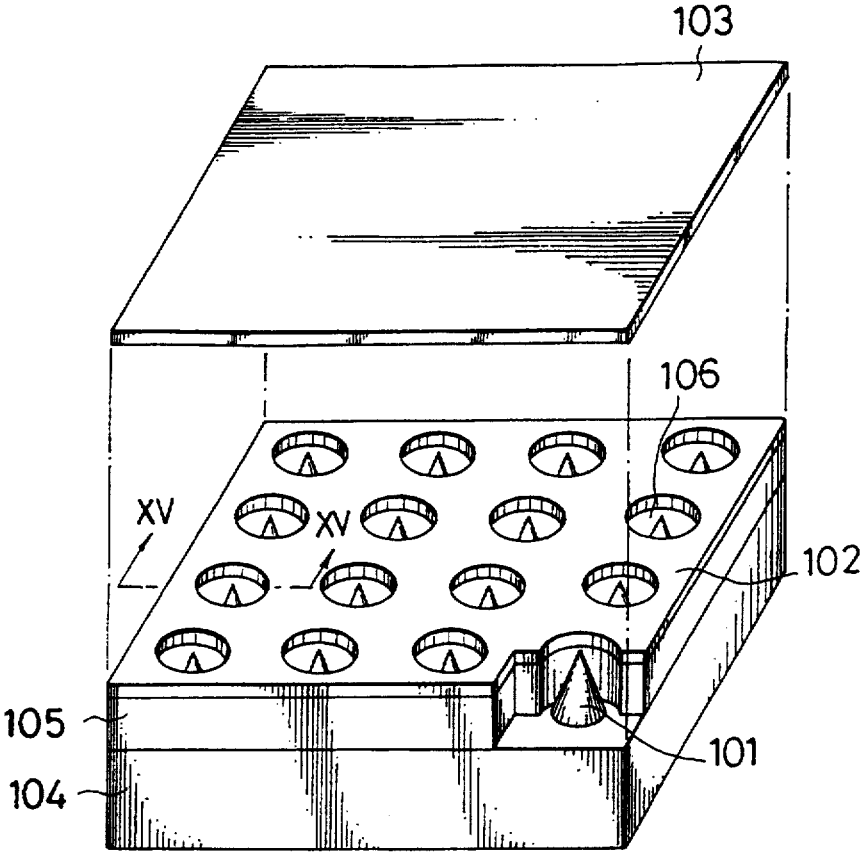
Figure 14:
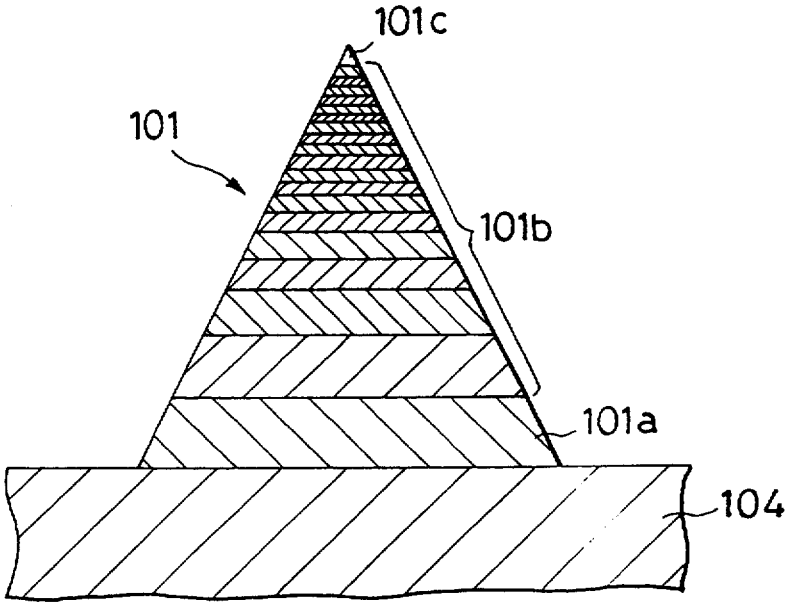
Figure 15:
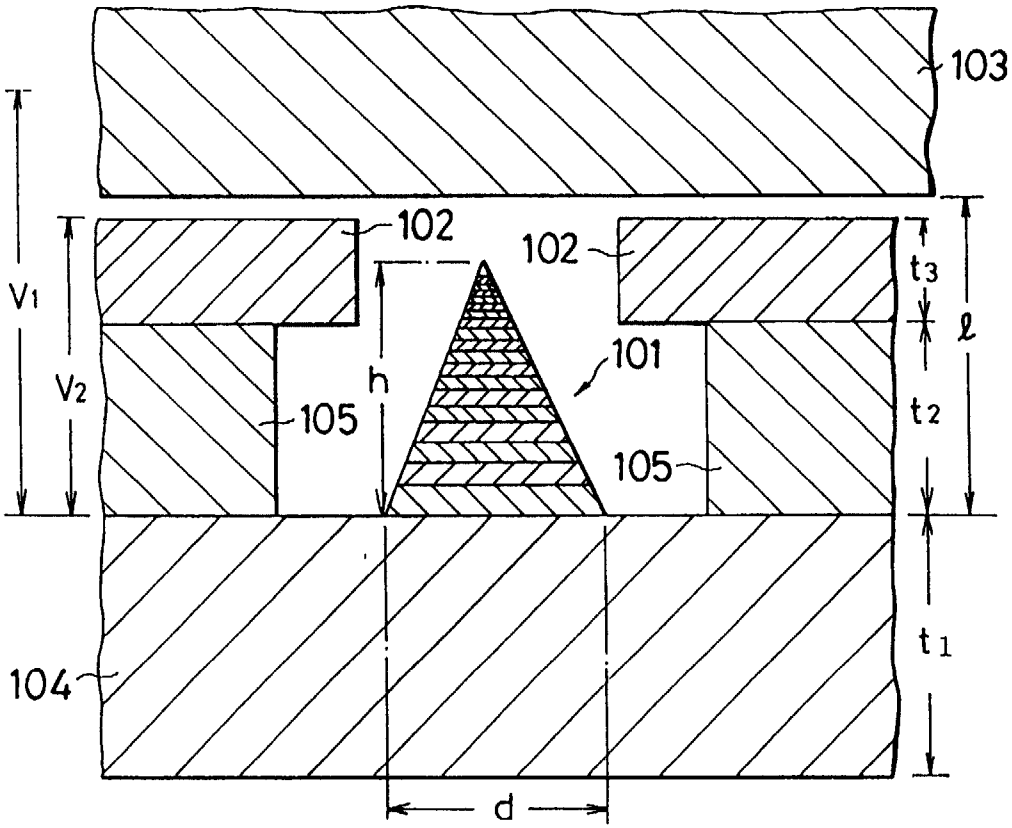
Figure 17:
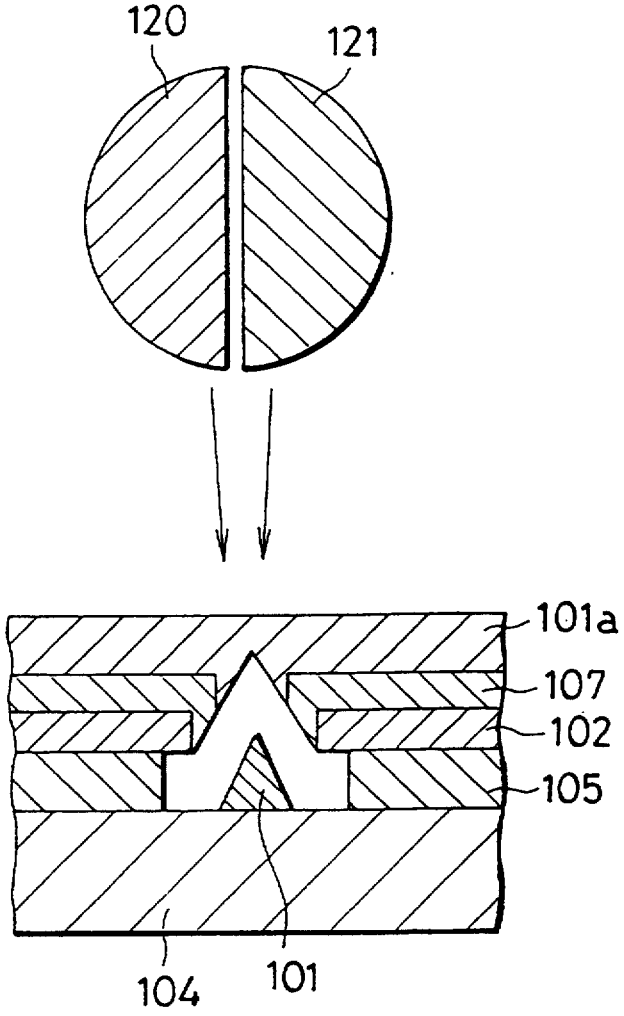
Figure 18:
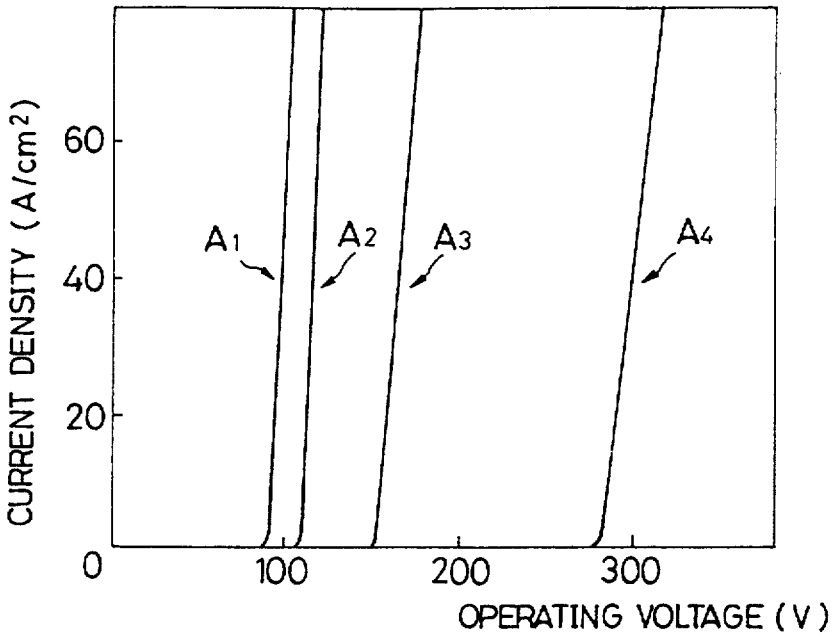
Figure 19:
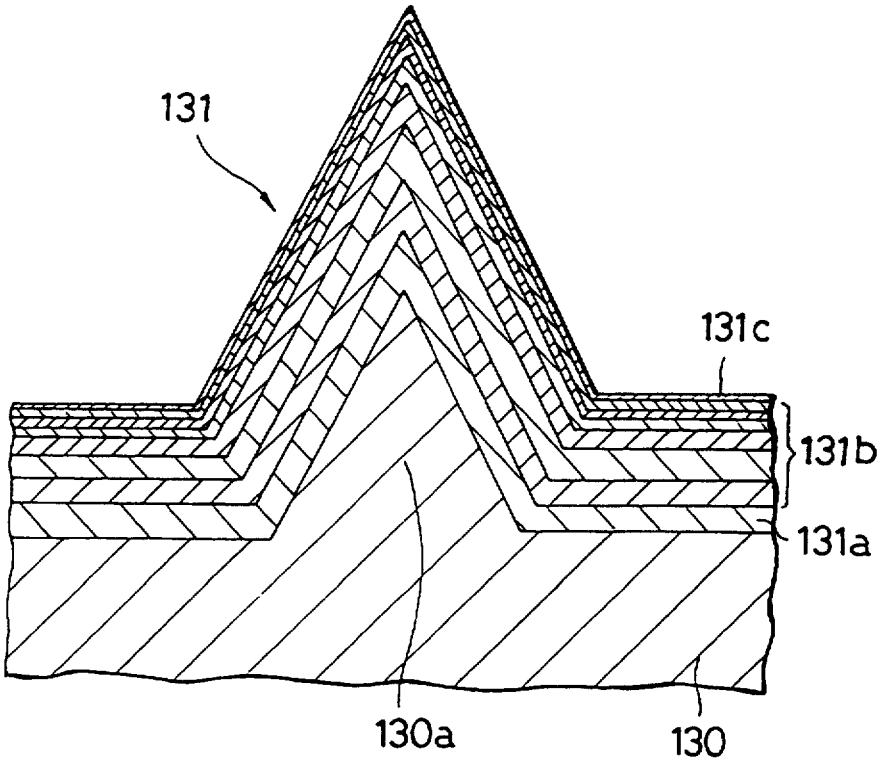
Figure 21:
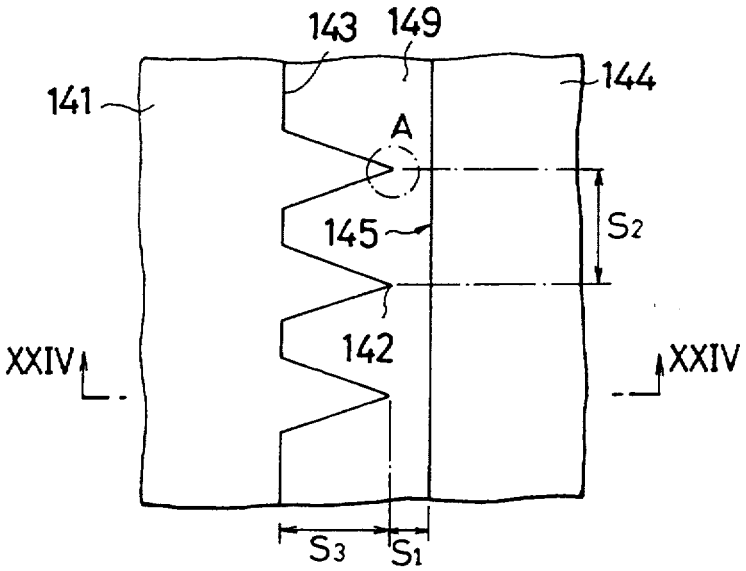
Figure 22:
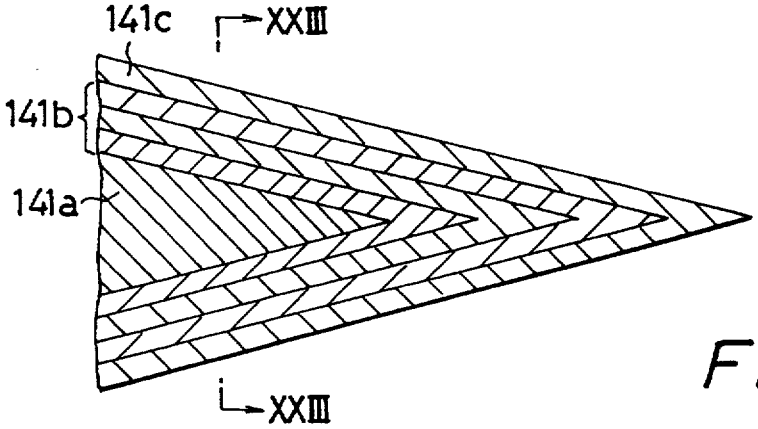
Figure 23:
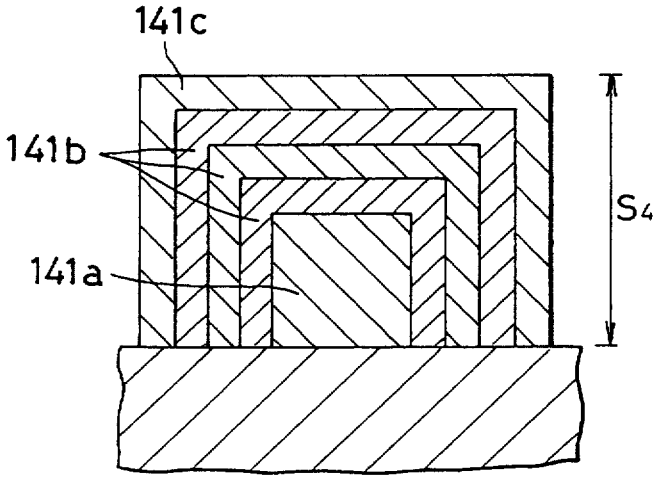

FIGS. 12*a*–12*f* are an essential sectional view showing a method for manufacturing the field-emission electronic device of FIG. 2;

FIG. 13 is a perspective view showing a field-emission electronic device according to another embodiment of the invention;

FIG. 14 is a side sectional view showing an essential portion of a field-emission cold cathode included in the field-emission electron source shown in FIG. 13;

FIG. 15 is a sectional view cut on the line XV—XV of FIG. 13;

FIGS. 16*a*–16*d* are a side sectional view showing a process for manufacturing the field-emission electron source shown in FIG. 13;

FIG. 17 is an explanatory view showing a method for manufacturing the field-emission cold cathode shown in FIG. 13;

FIG. 18 is a graph showing a relation between a voltage applied onto a gate electrode and an emitted current per one pixel of the field-emission cold cathode in the field-emission electron source shown in FIG. 13 and the known one;

FIG. 19 is a side sectional view showing an essential portion of a field-emission cold cathode included in a field-emission electron source according to another embodiment of the invention;

FIGS. 20*a*–20*e* are a side sectional view showing a process for manufacturing the field-emission electron source shown in FIG. 19;

FIG. 21 is a plane view showing a field-emission electron source according to another embodiment of the invention;

FIG. 22 is a plane sectional view showing a horizontal structure of the A part of the field-emission cold cathode shown in FIG. 21;

FIG. 23 is a side sectional view cut on the line XXIII—XXIII of the field-emission cold cathode shown in FIG. 22; and FIGS. 24*a*–24*d* are a side sectional view showing a process for manufacturing the field-emission electron source shown in FIG. 21;

DESCRIPTION OF THE PREFERRED EMBODIMENTS

In turn, the description will be directed to a field-emission electronic device according to a first embodiment of the invention.

Figure 1:
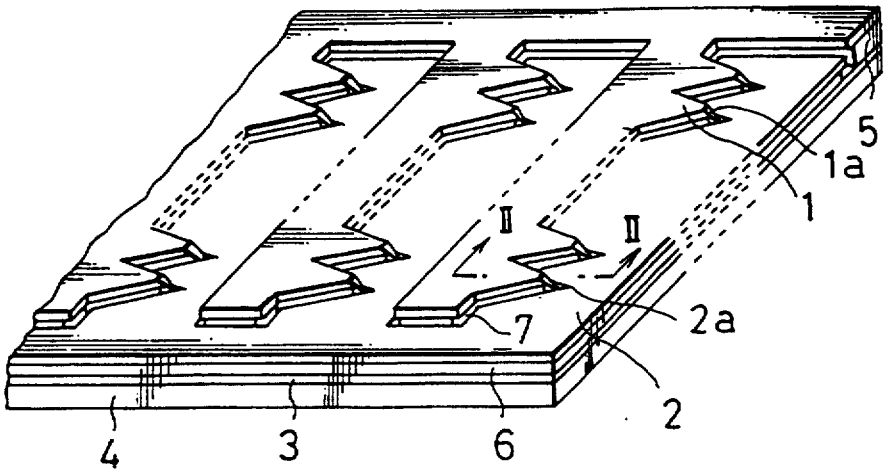
FIG. 1 is a perspective view showing a field-emission electronic device according to an embodiment of the invention.

FIG. 1 is a perspective view showing the field-emission electronic device. FIG. 2 is a sectional view cut on the II—II line of FIG. 1.

A field-emission electronic device employs as its substrate a high-resistance monocrystalline silicon substrate 4 such as a non-doped silicon substrate. On the silicon substrate 4, there is formed an anode electrode layer 3 made of molybdenum. On the anode electrode layer 3, a cathode electrode layer 1 is located with an insulating layer 5 laid therebetween and a gate electrode layer 2 is located with an insulating layer 6 laid therebetween. The cathode electrode layer 1 is opposed to the gate electrode with a groove 7 laid therebetween. The insulating layer 5 and 6 are both made of silicon dioxide. The cathode electrode layer 1 and the gate electrode layer 2 are both made of molybdenum. The horizontal distance d1 between the cathode electrode layer 1 and the gate electrode layer 2 is set as 0.1 to 0.5 μm. The thickness h1 of the insulating layer 5 is set as 0.2 to 1.0 μm and the thickness h2 of the insulating layer 6 is set as 0. 1 to 0.5 μm in a manner to keep a relation of $h1 > h2$. That is, the gate electrode layer 2 is provided between the anode electrode layer 3 and the cathode electrode layer 1.

As shown in FIG. 1, two layers opposed to each other with the groove 7 laid therebetween are formed to have a sawtooth form. The cathode electrode layer 1 serves to emit electrons at the tip of the sawtooth. There are arranged a plurality of linear-array sawtooth portions each having a lot of electron emitters. The tip 1*a* of the cathode electrode layer 1 is made acute in a manner to be inclined toward the gate electrode layer 2. The acute tip 1*a* is projected from the insulating layer 5 toward the groove 7. Likewise, the tip 2*a* of the gate electrode 2 is projected from the insulating layer 6 toward the groove 7.

As a material for each electrode layer, molybdenum is used. It is possible to use the conventional electrode materials such as chromium, tungsten, gold, silver, copper, aluminum. Any material may be used for the insulating layer if it has an insulating characteristic.

In the field-emission electron device arranged as above, when a voltage of about 20 V to 100 V is applied between the cathode electrode 1 and the gate electrode 2, a strong electric field of about $10^7$ V/cm takes place between the tip of the cathode electrode 1 and the gate electrode 2, so that the cathode electrode 1 may emit electrons at its tip on the field-emission principle. The emitted electrons reach the anode electrode layer 3 to which a predetermined voltage has been applied. As such, the groove 7 is an electron-moving space For the electrons emitted From the acute tip 1*a* of the cathode electrode 1. The amount of electrons emitted from the cathode electrode 1 increases or decrease as the gate voltage changes. Since the change of the gate voltage appears as the change of the anode current, therefore, the field-emission electronic device operates as a triode device.

As mentioned above, the distance between the electrodes is made to be changed from a known value of about 1 μm to a smaller value. Hence, it is possible to obtain the intensity of an electric field required for field emission when a lower voltage is applied to the gate. Further, since a distance between the anode electrode and the cathode electrode, that is, a thickness h1 of the insulating layer 5 can be set as 0.2 to 1.0 μm, it is possible to reduce the voltage applied to the anode and a time taken in moving electrons between the anode electrode and the cathode electrode. Moreover, in the field-emission electronic device according to this embodiment, as compared to the lamination of the cathode electrode and the gate electrode in the known structure, the overlapping area of the cathode electrode with the gate electrode can be reduced, resulting in making the capacitance between the cathode electrode and the gate electrode smaller. As such, the electronic device is capable of providing so large a cut-off frequency that it may operate at high speed.

In turn, the description will be directed to a field-emission electronic device according to another embodiment of the invention as referring to FIGS. 3 to 11. Each structure shown in each figure corresponds to one embodiment.

Figure 3:
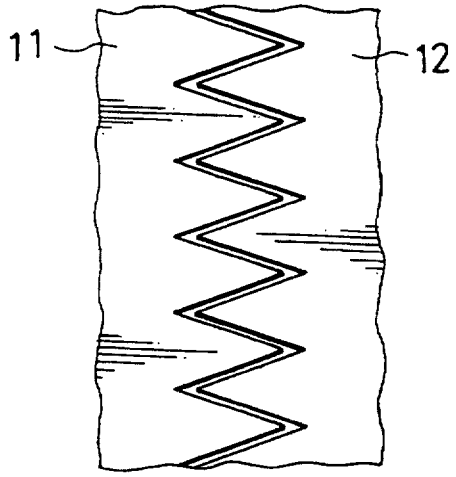
FIG. 3 is a partial plane view showing a field-emission electronic device according to the embodiment of FIG. 1.
Figure 4:
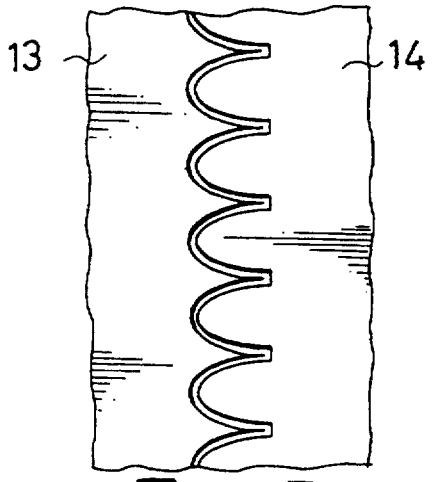
FIG. 4 is a partial plane view showing a field-emission electronic device according to another embodiment of the invention.
Figure 5:
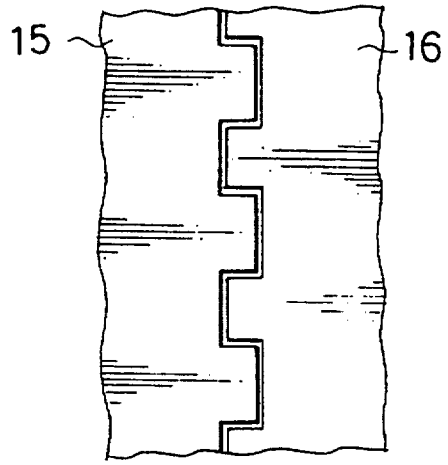
FIG. 5 is a partial plane view showing a field-emission electronic device according to another embodiment of the invention.

FIGS. 3 to 5 show a lamination composed of an insulating layer and a gate electrode layer, a lamination composed of an insulating layer and a cathode electrode layer, and a planar form of a groove spacing these layers from each other, respectively. FIG. 3 shows the same planar form of the lamination as that of the third embodiment. It has a structure where the mountains and the values of a sawtooth cathode electrode 11 engage with those of a sawtooth gate electrode 12. FIG. 4 shows the tip of the sawtooth cathode electrode 13 which is made more acute than that shown in FIG. 3. The gate electrode 14 is provided around each acute tip. In this structure, the electric field more effectively concentrates on the tip of the cathode electrode 13 through the form effect. It is therefore possible to reduce the gate voltage. However, the field emission takes place only at the tips. It results in inevitably making the field-emission area small. FIG. 5 shows a structure where the convexes and concaves of the cathode electrode are engaged with those of the gate electrode without using acute tips. As compared to the structures shown in FIGS. 3 and 4, the field concentration is disadvantageously made smaller, while the area for emitting electrons is advantageously made larger.

The structure shown in FIG. 3 has an intermediate feature between the structure shown in FIG. 4 and that shown in FIG. 5. That is, it is possible to set the planar form of the cathode electrode or the gate electrode in a manner to suit to the requested feature.

Figure 6:
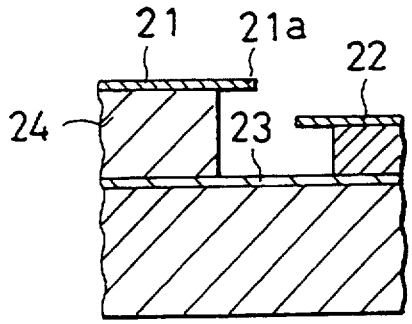
FIG. 6 is an essential sectional view showing a field-emission electronic device according to another embodiment of the invention.
Figure 7:
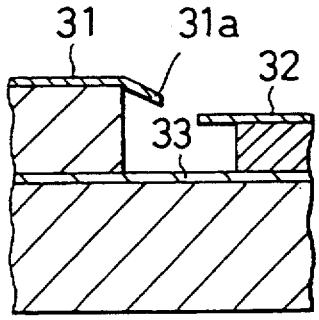
FIG. 7 is an essential sectional view showing a field-emission electronic device according to another embodiment of the invention.
Figure 8:
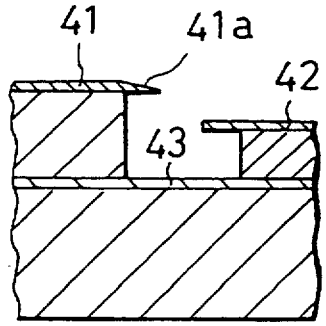
FIG. 8 is an essential sectional view showing a field-emission electronic device according to another embodiment of the invention.
Figure 9:
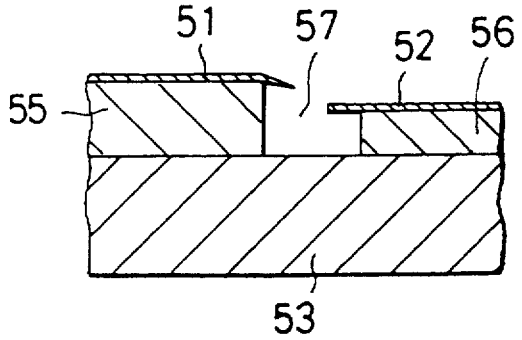
FIG. 9 is an essential sectional view showing a field-emission electronic device according to another embodiment of the invention.

FIGS. 6 to 8 show other sectional forms of the tip of the cathode electrode layer in the groove served as an electron-moving space, respectively. The structure shown in FIG. 6 is the fundamental form. The tip 21*a* of the cathode electrode 21 is projected from the insulating layer 24 without changing the thickness of the tip 21*a* at the same level of the cathode electrode 21 on the insulating layer 24. This structure provides the tip of the cathode which is excellent in mechanical strength and is allowed to be manufactured by an easier process. The structure shown in FIG. 7 provides the tip 31*a* of the cathode electrode 31 projected in a manner to be inclined toward the gate electrode 32. This structure is formed by considering the optimization of the distribution of an electric field around the tip of the cathode electrode 31 and the direction of electron emission based on the field emission. The structure shown in FIG. 8 is formed so that the tip 41*a* of the cathode electrode 41 is made acute toward the thickness of the cathode electrode. This structure offers at advantage that an electric field is concentrated around the tip 41*a* of the cathode electrode 41 through the form effect. The advantage makes it possible to lower the gate voltage. The structure shown in FIGS. 1 and 2 is a combination of the structure shown in FIG. 7 and the structure shown in FIG. 8.

As described above, the field-emission electronic device according to the present invention enables to freely take a form of an electron-emitting portion of the cathode electrode and orient the tip. Hence, the field concentration around the cathode tip can be effectively implemented, resulting in achieving the increase of an emitted current density based on the field emission.

As shown in FIG. B, the field-emission electronic device may provide a conductive anode electrode substrate 53 having an integral combination of the substrate and the anode electrode. For the anode electrode substrate 53, a low-resistance monocrystalline silicon substrate or a metal plate may be used. In a case that the anode electrode substrate 53 is made of monocrystalline silicon, an oxidized silicon layer formed by heat oxidation may be used for insulating layers 55 and 56 in light of the manufacturing process. The silicon dioxide layer obtained by thermally oxidizing monocrystalline silicon is more excellent in an insulating characteristic as compared to the layer formed by the vacuum evaporation, for example. Hence, it is suitable to the insulating layer. In addition, the silicon substrate is allowed to be monolithically integrated with another electronic component. This makes contribution to simplifying the manufacturing process.

Figure 10:
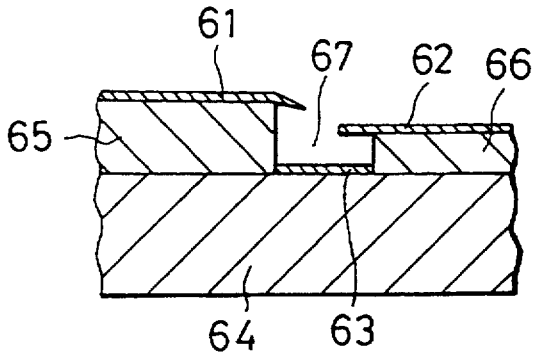
FIG. 10 is an essential sectional view showing a field-emission electronic device according to another embodiment of the invention.
Figure 11:
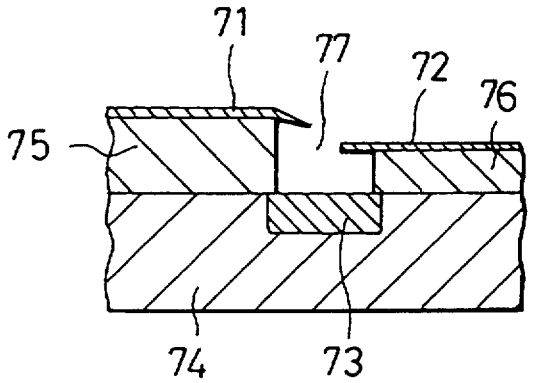
FIG. 11 is an essential sectional view showing a field-emission electronic device according to another embodiment of the invention.

As a structure of another embodiment, as shown in FIG. 10, a beltlike (extending in the vertical direction on paper) anode electrode layer 83 is deposited on the surface of the silicon substrate 84 located on the bottom of a groove 67. As a structure of another embodiment, as shown in FIG. 11, a beltlike (extending in the vertical direction on paper) anode electrode layer 78 is buried in the silicon substrate 74 in a manner to expose its surface on the bottom of a groove 77. Herein, the substrate 74 employs a high-resistance monocrystalline silicon substrate such as a non-doped silicon substrate and the anode electrode 73 may be formed of an n-type low-resistance area by doping an n-type impurity such as phosphorus on the beltlike part of the substrate 74. The low-resistance area may be a p-type low-resistance area formed by doping an p-type impurity such as boron. In the structures shown in FIGS. 10 and 11, the area of the anode electrode layer occupying the substrate is made smaller. This makes it possible to reduce the overlapped area of the cathode electrode and the anode electrode (against the substrate surface) and the overlapped area of the gate electrode and the anode electrode. As such, it is possible to reduce the capacitances between the cathode electrode and the gate electrode, between the cathode electrode and the anode electrode and between the gate electrode and the anode electrode. This results in increasing a cut-off device $f_T$ of the device, thereby being able to operate the electronic device at high speed.

turn, the description will be directed to a process for manufacturing a field-emission electronic device according to the first embodiment as referring to FIG. 12.

The manufacturing method according to this embodiment is arranged to independently set each interval between the anode electrode and the gate electrode, between the gate electrode and the cathode electrode, or between the anode electrode and the gate electrode. Further, the method makes it possible to make the cathode electrode acute or orient the acute electrode in respective steps. In addition, the method needs just one transfer of a fine mask pattern to a resist. As such, it does not need to accurately position the mask pattern.

Figure 12A:
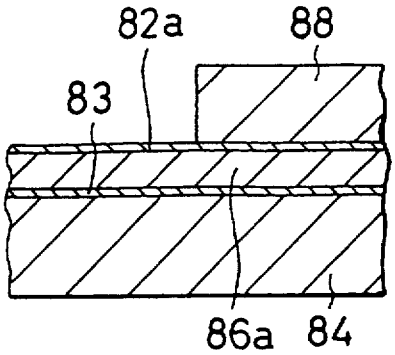

The sections shown in FIGS. 12*a* to 12*f* show the respective manufacturing steps. As shown in FIG. 12*a*, an anode electrode metal layer 83 having a thickness of about 0.1 μm is deposited on a substrate 84. An insulating layer 86*a* having a thickness of about 0.3 μm is deposited on the layer 83. Then, a gate electrode metal layer 82*a* having a thickness of about 0.1 μm is deposited on the insulating layer 86*a*. Further, a resist mask 88 is formed on the layer 82*a*. The thickness of the insulating layer 86*a* corresponds to an interval between the anode electrode and the gate electrode. The electrode metal layers 83, 82*a* and the insulating layer 86*a* have been formed by the electron-beam evaporating technique. In place, the sputtering technique or the CVD technique may be used according to the used material.

Figure 12B:
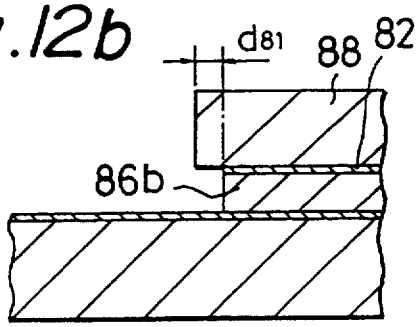

Next, along the mask 88, as shown in FIG. 12*b*, the gate electrode metal layer 82*a* is selectively etched for removal. Then, the gate electrode metal layer 82*a* is side-etched by a width shown by d81. The side-etched length d81 corresponds to a horizontal distance between the cathode electrode 81 and the gate electrode 82. Next, like the removal of the gate electrode metal layer 82*a*, the insulating layer 86*a* is etched for removal.

Figure 12C:
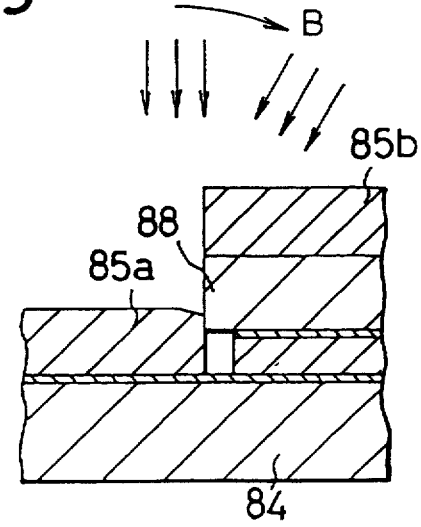
Figure 12D:
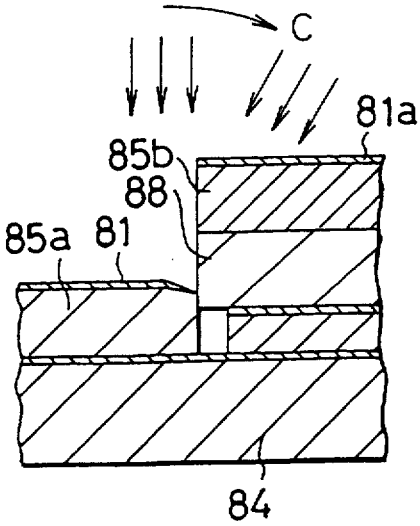

As shown in FIG. 12*c*, an insulating layer 85*a* is formed by the vacuum evaporating technique using an electron beam. Herein, by moving the evaporating source or rotating the substrate 84 as shown by an arrow B, the angle of evaporating direction is relatively changed by several degrees (until 20). Then, the insulating layer 85*a* is evaporated toward the mask 88 in a manner to make its thickness somewhat thinner. With the evaporation, it is possible to set the direction of the tip of the cathode electrode. The thickness of the overall insulating layer 85*a* corresponds to an interval between the anode electrode and the cathode electrode. As shown in FIG. 12*d*, the cathode electrode metal layer 81 is formed by the electron-beam vacuum evaporating technique. By moving the evaporating source or rotating the substrate 84, as shown by an arrow C, the angle of the evaporating direction is allowed to be relatively changed from some to twenty degrees. The cathode electrode metal layer 81 is evaporated against the resist mask 88 in a manner to make the metal layer 81 more acute toward its thickness.

Figure 12E:
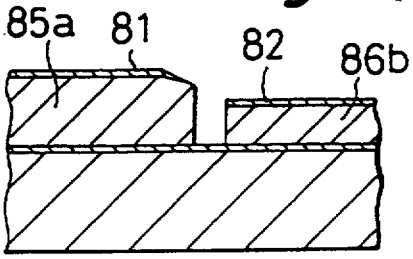
Figure 12F:
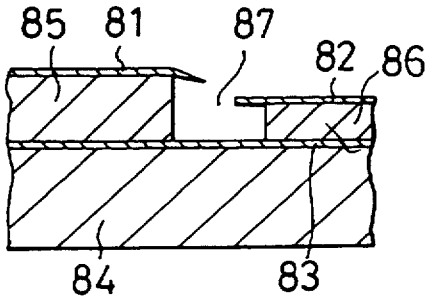

Later, the mask 88, the insulating layer 85*b* deposited on the mask, and the cathode electrode material layer 81*a* deposited on the layer 85*b* are all removed. The resulting structure is as shown in FIG. 12*e*. Further, the insulating layers 85*a* and 86*b* are side-etched so that the acute tip of the cathode electrode 81 and the tip of the gate electrode 82 are allowed to be projected toward the groove 87. The resulting structure is as shown in FIG. 12*f*. This is an intended field-emission electronic device.

With this manufacturing method, it is possible to manufacture the field-emission electronic device which provides a lower operating voltage and a high-speed operation.

In turn, the description will be directed to a field-emission electronic device according to a second embodiment of the invention as referring to FIGS. 13 to 18. This field-emission electronic device relates to a field-emission electron source.

FIG. 13 is a perspective view showing a field-emission electronic element according to the second embodiment of the invention.

A substrate electrode 104 is formed of monocrystalline silicon having low resistance. On the substrate electrode 104, a lot of conical cold cathode chip 101 are formed. Each cold cathode chip is made of the same monocrystalline silicon as the substrate electrode 104 or a high melting point metal such as tungsten (W) or molybdenum (Mo). An insulating layer 105 is formed on the substrate electrode 104 around the cold cathode chips 101 On the insulating layer 105, a gate electrode 102 is deposited. An anode electrode 103 is provided to cover those cold cathode chips 101 and the gate electrode 102 with keeping a space surrounded by at least the anode electrode 103, the cold cathode chips 101 and the gate electrode 102 to be vacuum.

FIG. 14 is a sectional view showing an essential side portion of a field-emission cold cathode chip included in the second embodiment of FIG. 13. FIG. 15 is a sectional view cut on the line XV—XV of FIG. 13 showing an essential portion of the field-emission electron source and dimensions of components included in the field-emission electron source.

As shown in FIG. 14, the cold cathode 101 is composed of three kinds of layers 101*a*, 101*b* and 101*c*. A titanium layer 101*a* is deposited on a silicon substrate electrode 104. On the titanium layer 101*a*, a titanium and titanium carbide layer 101*b* having a plurality of layers is deposited on the titanium layer 101*a*. The layer 101*b* are made of titanium and titanium carbide and the mixing ratio of the materials at the upper portion of the layer is larger than the lower portion. That is, the upper layer of the titanium and titanium carbide layer 101*b* has a larger composition ratio of carbon than the lower layer. On the top of the titanium and titanium carbide layer 101*b*, a titanium carbide layer 101*c* is deposited.

As shown in FIG. 15, on the substrate electrode 104 around the field-emission cold cathode 101, an insulating layer 105 is formed in a manner to surround the field-emission cold cathode. On the insulating layer 104, there is laminated a gate electrode 102. Above the gate electrode layer 102, an anode electrode 109 is disposed to cover the cold cathode 101 and the gate electrode 102. A space surrounded by the field-emission cold cathode 101, the gate electrode 102, the insulating layer 105, the substrate 104 and the anode electrode 103 is kept to be vacuum.

The conical field-emission cold cathode 101 is formed in such a manner that its bottom diameter d is d=about 0.8 μm and its height h is h=about 1 μm. The substrate electrode 104 has a thickness t1 of about 0.75 mm. The insulating layer 105 has a thickness t2 of about 0.75 μm. The gate electrode 102 has a thickness t3 of about 0.5 μm. The distance l between the anode electrode 103 and the substrate electrode 104 is l=about 10 μm.

In the field-emission electron source according to the second embodiment mentioned above, the field-emission cold cathode is made of metallic carbide having a small work function. Hence, it operates on a smaller operating voltage as described later. The field-emission cold cathode 101 has a lamination structure having the titanium carbide layer 101*c*, the titanium and titanium carbide layer 101*b* and the titanium layer 101*a* as shown in FIG. 14. As such, the difference of a thermal expansion coefficient between the titanium layer 101*a* and the substrate 104 is small. Likewise, the differences of the thermal expansion coefficient between the titanium carbide layer 101*c* and the titanium and titanium carbide layer 101*b* and between the titanium layer 101*a* and the titanium and titanium carbide layer 101*b* and between the titanium layers 101*a* are also small. It means that the lamination structure is sufficiently thermally stable and mechanically endurable. Moreover, since the electric resistance from the titanium layer 11*a* to the titanium carbide layer 101*c* located at the tip is continuously changed, the electric conductivity inside of the cold cathode is improved.

Next, the description will be directed to a process for manufacturing the field-emission electron source according to the second embodiment of the invention as referring to FIGS. 16 and 17.

FIG. 16 is a sectional side view showing a process for manufacturing the field-emission electron source shown in FIG. 15. FIG. 17 is an explanatory view showing a method for manufacturing the field-emission cold cathode in detail.

At first, the top surface of the silicon substrate electrode 104 is subject to the thermal oxidation of about 1100° C. The silicon substrate electrode 104 is conductive (0.01 Ω.cm) and has a thickness of about 0.75 mm. After the thermal oxidation, the insulating layer 105 made of silicon dioxide ($SiO_2$) is formed to have a thickness of about 0.75 μm. Then, on the insulating layer 105, a layer corresponding to the gate electrode 102 is formed by the electron-beam evaporation or sputtering. The layer is made of molybdenum and has a thickness of about 0.5 μm. Next, a resist (not shown) is spin-coated on the gate electrode 102 in a manner to have a thickness of about 1 μm. Then, a spot pattern having a diameter of about 1 μm is exposed by an electron beam. The exposed resist is developed by isopropyl alcohol so that a spot opening may be formed on the molybdenum layer. The spot opening has a diameter of about 1 μm. Next, the molybdenum layer and the insulating layer under the spot opening are selectively etched so that a circular opening 106 having a diameter of about 2 μm may be formed on the substrate electrode 104. Next, after the resist is removed by an organic solvent, the etching is carried out by using hydrofluoric acid. Then, the layer made of molybdenum, which will become the gate electrode 102, is undercut so as to form the structure shown in FIG. 16*a*. In this embodiment, the molybdenum has been used for making the gate electrode 102. However, any metal may be used if it has the substantially same performance. Likewise, the silicon oxide has been used for making the insulating layer 105. However, any material may be used if it has the substantially same performance.

Figure 16A:
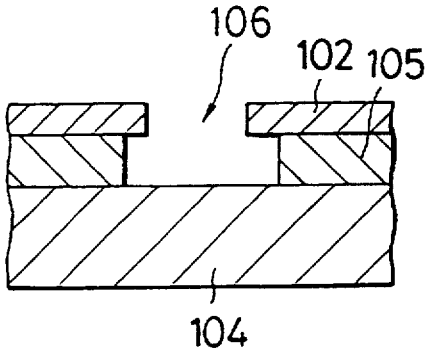

Next, the structure shown in FIG. 16*a* is installed in a vacuum evaporating unit, in which the silicon substrate electrode 104 is rotated on the shaft of the circular opening 106. From an upper oblique location shown by an arrow A of FIG. 16*b*, aluminum is deposited on the gate electrode 102 in a manner that the diameter of the circular opening 106 may progressively become smaller from the lower to the upper. The resulting structure is that shown in FIG. 16*b*.

Figure 16C:
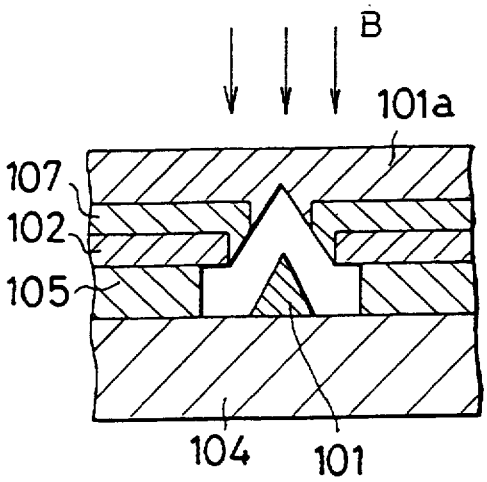
Figure 16B:
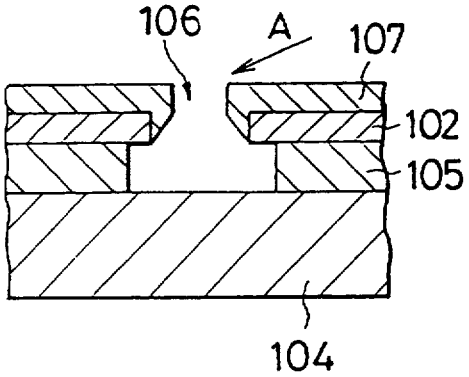
Figure 16D:
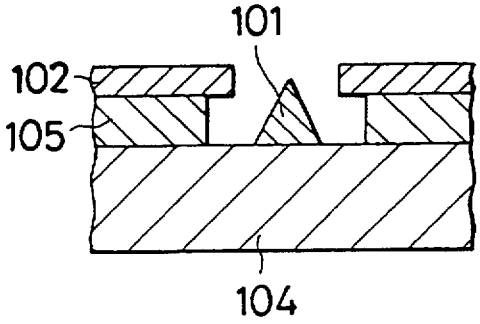

Then, a material for the field-emission cold cathode is deposited on the substrate electrode 104 through the circular opening 106 by an electron beam evaporation so that the field-emission cold cathode 101 may be formed on the silicon substrate electrode 104. When the material is evaporated by an electron beam from the direction shown by an arrow B through the circular opening 106 as shown in FIG. 16*c*, a deposit layer 101*a* of the material is formed in a manner to gradually decrease the diameter of the circular opening 106 and finally close the circular opening 106. This is the conical field-emission cold cathode 101. By removing the aluminum layer 107 and the deposit layer 101*a*, the structure shown in FIG. 16*d* is formed. In this embodiment, about 5000 field-emission cold cathodes 101 are formed with a spacing of about 10 μm between the adjacent ones.

In this embodiment, as shown in FIG. 17, for forming the field-emission cold cathode 101, a two-source evaporation is used. The evaporation has a metal evaporating source 120 of titanium (Ti) and a metallic carbide evaporating source 121 of titanium carbide (TiC). At first, with the metal evaporating source 120 only, the titanium layer is evaporated. Then, by adjusting an evaporating rate of the two evaporating sources 120 and 121, the titanium and titanium carbide layer is formed in a manner to continuously keep the carbon ratio higher from the bottom to the tip. Finally, with the metallic carbide evaporating source 121 only, the titanium carbide layer is formed on the top of the field-emission cold cathode 101. In place of the titanium evaporating source 120, it is possible to use a metal evaporating source for zirconium (Zr), molybdenum (Mo) and hafnium (Hf). In place of the metallic carbide evaporating source of titanium carbide (TiC), it is possible to use a metal evaporating source for metallic nitride, metallic oxide or metallic boride.

FIG. 18 is a graph showing a relation between an operating voltage and a discharged current density, that is, emission current caused by field emission per one pixel in the field-emission electron source of this embodiment and the known field-emission electron source. Herein, the operating voltage is a voltage to be applied between the anode electrode and the substrate electrode.

The curves indicated by symbols A1 to A3 represent the relations between the discharged current density and the operating voltage in this embodiment, and the curve of symbol A4 represents the relation of a conventional field-emission type electron source. The curves A1 to A4 correspond to respective materials of the field-emission cold cathode, that is, zirconium carbide, titanium carbide, titanium nitride, and molybdenum. The curve indicated by a symbol A4 represents the relation of the known field-emission electron source.

The relation indicated in FIG. 18 is obtained by applying a positive voltage V2 of 50 V between the substrate electrode 104 and the gate electrode 102 based on the voltage of the substrate electrode 104 and measuring the discharged current as changing the applied voltage V1 (operating voltage) between the anode electrode 103 and the substrate electrode 104 (see FIG. 15). As is obvious from this figure, in the relation A4 of the conventional device, the threshold value of the operating voltage is about 300 V. On the other hand, in the relations A1 to A3 of this embodiment, the threshold values are about 100 V to 150 V. The great reduction of the operating voltage results from the reduction of the work function of the field-emission cold cathode.

In turn, the description will be directed to a field-emission electronic device according to a third embodiment of the invention as referring to FIGS. 19 and 20.

FIG. 19 is a side sectional view showing an essential portion of the field-emission cold cathode 131 included in a field-emission electron source according to the third embodiment. FIG. 20 is a side sectional view showing a process for manufacturing the field-emission electron source.

A silicon substrate electrode 130, as shown in FIG. 19, comprises a pyramid convex portion 130*a*. Though one convex portion 130*a* is shown in FIG. 19, in actual, the substrate 130 includes a number of convex portions 130*a* formed on the same surface thereof. On each convex portion 130*a*, a pyramid field-emission cold cathode 131 is formed. The form of the convex portion 130*a* and the field-emission cold cathode 131 is not limited to a pyramid. It may be a conical or an edge-sawtooth form to be discussed with respect to a third embodiment. This edge-sawtooth form implements a larger surface area.

The bottom of each field-emission cold cathode 131 is formed of a titanium layer 131*a*. On the titanium layer 131*a*, a titanium and titanium carbide layer 31*b* is formed in a manner to progressively increase a composition ratio of carbon. On the layer 131*b*, a titanium carbide layer 131*c* is formed.

Next, the process for manufacturing a field-emission electron source shown in FIG. 19 will be described as referring to FIG. 20. At first, a conductive (0.01 Ω.cm) silicon substrate electrode 130 is prepared. It needs to have a thickness of about 0.4 mm is prepared. The silicon substrate electrode is subject to heat oxidation at the temperature of about 1100° C. so as to form silicon dioxide ($SiO_2$) having a thickness of about 0.2 μm. Next, a resist of about 1 μm is coated on this layer. The resist is exposed by ultraviolet rays and is developed for forming a resist mask (not shown). The silicon dioxide layer is etched by a mixed liquid of hydrofluoric acid and ammonium fluoride so as to form a mask 132 of silicon oxide. Then, the resist is removed by an organic solvent. The resulting structure is shown in FIG. 20*a*.

Figure 20A:
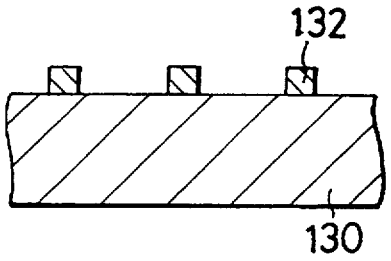
Figure 20D:
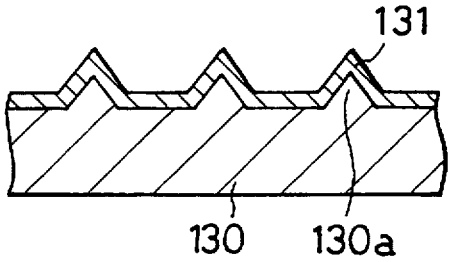
Figure 20B:
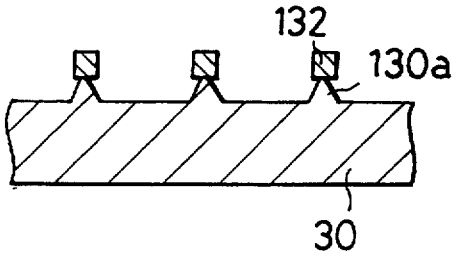

Next, the structure shown in FIG. 20*a* is etched by an etchant of a mixed liquid of hydrofluoric acid, nitric acid and acetic acid. The etching results in eroding the silicon substrate electrode 130 so that pyramid convex portions 130*a* are formed as shown in FIG. 20*b*. Next, the silicon oxide mask 132 is removed by a mixed liquid of hydrofluoric acid and ammonium fluoride. As shown in FIG. 20*c*, the pyramid convex portions 130*a* are left as a mother body of the field-emission cold cathode 131. This kind of pyramid convex portion 130*a* may be formed by anisotropic etching with an alkali mixed liquid containing potassium hydroxide and isopropyl alcohol or dry etching such as RIE (Reactive Ion Etching).

A material of the field-emission cold cathode 131 is coated on the convex portion 130*a* by means of the sputtering. The layers composing the filed-emission cold cathode 131 are formed as shown in FIG. 20*d*. For a sputter target, some metal such as titanium is used. For a reactive gas, a mixed gas containing argon (Ar) and methane ($CH_4$) is used. By the reactive sputtering, a thin film made of the titanium carbide is formed.

By controlling a mixing ratio of the reactive gas, as shown in FIG. 19, at first, the titanium layer 131*a* is evaporated. Then, the titanium and titanium carbide layer 131*b* is formed in a manner to progressively increase a composition ratio of carbon from the bottom to the tip. At the top, the titanium carbide layer 131*c* is formed. For a sputter target, in place of titanium (Ti), zirconium (Zr), molybdenum (Mo) or hafnium (Hf). As a reactive gas, nitrogen or ammonium is used for nitride and oxygen is used for oxide.

Figure 20E:
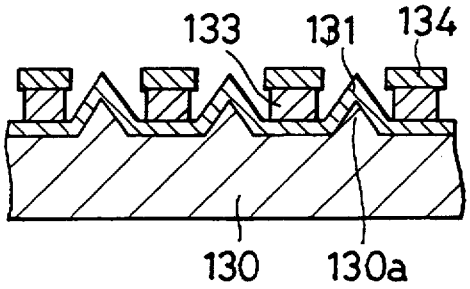
Figure 20C:
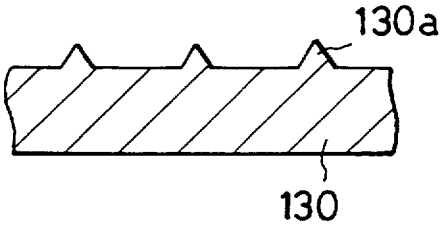

Next, as shown in FIG. 20*e*, an insulating layer 133 and a gate electrode 134 are formed on the silicon substrate electrode 130 around the pyramid field-emission cold cathode 131. Then, after an anode electrode is formed (not shown), the process for manufacturing the field-emission electron source is terminated.

The field-emission electron source according to the third embodiment is thus capable of reducing the operating voltage like the second embodiment.

In manufacturing the field-emission cold cathode according to the second and third embodiments, it is possible to use a vapor growth method such as CVD or MOCVD or another filming method. The form of the field-emission cold cathode is not limited to the pyramid form. In actual, several forms can be realized by selecting the method. For example, with the vapor growth method, to form the titanium carbide layer, it is possible to employ a method for reacting titanium tetrachloride with methane.

In turn, the description will be directed to a field-emission electronic device according to a fourth embodiment of the invention as referring to FIGS. 21 to 24. The electronic device also relates to a field-emission electron source. The electron source according to this embodiment has a cold cathode formed unlike the pyramid. FIG. 21 is a plane view showing the Field-emission electron source according to the fourth embodiment. The field-emission electron source is constructed to have a sawtooth-edge cold cathode emitter 141 and a linear-edge gate 144 on a crystalline substrate 149 in a manner to oppose the cold cathode emitter 141 to the gate 144. The cold cathode emitter 141 serves to emit electrons at its tip 142. FIG. 22 is an expanded plane section showing a horizontal section of the field-emission cold cathode, in particular, an A portion. Toward the bottom of the emitter, there are formed a titanium (Ti) layer 141a and a mix layer 141b of a titanium and titanium nitride is formed on the titanium layer 141a. The mix layer 141b is composed of a plurality of layers having a different mixing ratio of a titanium and titanium nitride. The layer 141b is formed in a manner to increase a nitrogen density as it comes closer to the tip. A titanium nitride (TiN) layer 141c is formed on the surface of the mix layer 141b.

FIG. 23 is a sectional view showing a vertical section of the field-emission cold cathode, in particular, an essential portion cut on the line XXIII—XXIII of FIG. 22. The structure formed in a manner to increase a nitrogen density as it comes closer to the side surface.

In the sawtooth field-emission electron source of the third embodiment, in FIG. 21, a distance S1 between the tip 142 of the cold cathode emitter 141 and the edge 145 of the gate 144 is 1 μm. A distance S2 between the adjacent tips 142 of the cold cathode emitters is 5 μm. A distance S3 between the tip 142 and a mother body 143 of the cold cathode emitter is 5 μm. In FIG. 23, a thickness S4 of the emitter 141 is 0.5 m.

Next, the process for manufacturing the field-emission electron source will be described as referring to FIG. 24, which is a vertical sectional view showing an essential portion cut on the line XXIV—XXIV of FIG. 21.

Figure 24A:
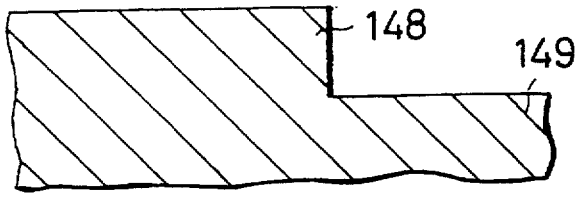

At first, photo-etching is performed on the crystalline ($SiO_2$) substrate 149 so as to pattern the substrate 149 to have a convex portion 148 of a sawtooth, which will become a ground of the cold cathode emitter. The resulting structure is shown in FIG. 24a.

Figure 24B:
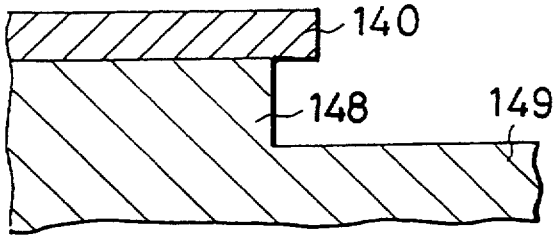
Figure 24C:
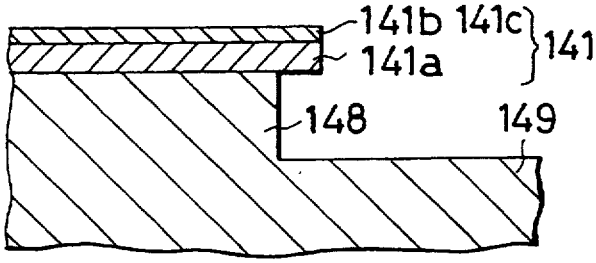

Next, a titanium layer 140 is formed on the convex portion 148 by the sputtering. The layer 140 will become the cold cathode emitter. Further, the crystalline substrate is side-etched by a mixed liquid of hydrofluoric acid and ammonium Fluoride (BHF). The resulting structure is shown in FIG. 24b. Next, with a mixture gas of argon (Ar) and ammonium ($NH_3$), a titanium nitride (TiN) layer is formed on the surface of the thin film cold cathode 141. In the formation, as the flow rate of an argon gas to ammonium is being controlled, the mixture ratio of the gas is continuously changed in a manner to gradually increase a ratio of ammonium to the argon gas when the nitride reaction of the material for the cold cathode is carried out at a high temperature of about 500° to 900° C. The resulting structure is shown in FIG. 24c. In this case, as a sputter target, in place of titanium (Ti), zirconium (Zr) or molybdenum (Mo) may be used. As a reactive gas, nitrogen ($N_2$) may be used in place of ammonium.

Figure 24D:
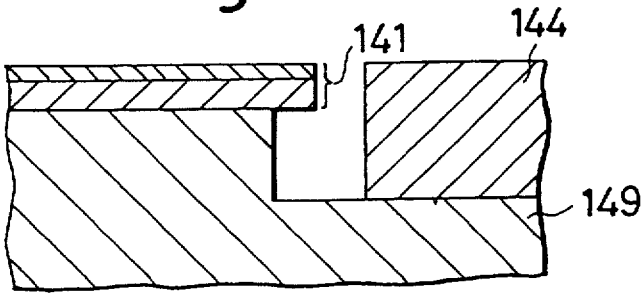

By performing the photo-etching and evaporating the gate metal, the gate 144 is formed. The resulting structure is shown in FIG. 24d. This is an end of the process for manufacturing the field-emission electron source.

Many widely different embodiments of the present invention may be constructed without departing from the spirit and scope of the present invention. It should be understood that the present invention is not limited to the specific embodiments described in the specification, except as defined in the appended claims.

What is claimed is:

1. A field-emission electronic device comprising:

an anode electrode layer;

a first insulating layer disposed on one surface of said anode electrode layer;

a cathode electrode layer disposed on said first insulating layer and provided with a plurality of tips each emitting electrons;

a second insulating layer disposed on the surface of said anode electrode layer at a distance from said first insulating layer relative to a horizontal direction parallel with the surface of said anode electrode layer;

a gate electrode layer disposed on said second insulating layer opposite to said tips; and a portion of said anode electrode layer, which serves to collect electrons emitted by said tips, being located between said tips of said cathode electrode layer and said gate electrode layer relative to the horizontal direction.

2. A field-emission electronic device according to claim 1, wherein said gate electrode layer is located between said tips of said cathode layer and said anode layer in a direction orthogonal to the horizontal direction.

3. A field-emission electronic device according to claim 2, wherein said anode electrode layer is formed on one surface of a substrate.

4. A field-emission electronic device according to claim 1, wherein said device comprises a substrate as said anode electrode layer.

5. A field-emission electronic device according to claim 3, wherein said cathode electrode layer is shaped like a sawtooth in plane in the horizontal direction such that each tip corresponds to each top part of the sawtooth-shaped layer and said gate electrode layer corresponds in shape to said cathode electrode layer.

6. A field-emission electronic device according to claim 3, wherein said cathode electrode layer is shaped in such a manner that said tips have top flat projecting portions arranged at regular intervals in plane and said gate electrode layer corresponds in shape to said cathode electrode layer.

7. A field-emission electronic device according to claims 3, 4, 5 or 6, wherein each tip projects outwardly from said first insulating layer in parallel with the surface of said anode electrode.

8. A field-emission electronic device according to claims 3, 4, 5 or 6, wherein each tip projects outwardly from said first insulating layer in such a manner as to be inclined toward said gate electrode layer.

9. A field-emission electronic device according to claim 6, where each tip is made acute toward the thickness thereof.

10. A field-emission electronic device according to claim 4, wherein said cathode electrode layer is shaped like a sawtooth in plane in the horizontal direction such that each tip corresponds to each top part of the sawtooth-shaped layer and said gate electrode layer corresponds in shape to said cathode electrode layer.

11. A field-emission electronic device according to claim 8, wherein each tip projects outwardly from said first insulating layer in such a manner as to be inclined toward said gate electrode layer.

12. A field-emission electronic device according to claim 11, wherein each tip is made acute toward the thickness thereof.

13. A field-emission electronic device according to claim 10, wherein each tip includes a first portion made of a metallic material and electrically connected to a body of said cathode electrode layer, a second portion composed of a plurality of successive layers each made of a mixture of the metallic material and one of a carbide, a nitride, an oxide and a boride of the metallic material and laminated on said first portion in the horizontal direction, and a third portion, which corresponds to a top part of each tip that forms a top portion of the sawtooth-shaped cathode, made of one of a carbide, a nitride, an oxide and a boride of the metallic material and laminated on said second portion, composition ratios of carbon, nitrogen, oxygen or boron of the layers in said second portion being gradually increased from the bottom of the layers adjacent to said first portion to the top of the layers adjacent to said third portion.

14. A field-emission electronic device comprising:

a substrate;

a first insulating layer disposed on one surface of said substrate;

a cathode electrode layer disposed on said first insulating layer and provided with a plurality of tips each emitting electrons;

a second insulating layer disposed on the surface of said substrate at a distance from said first insulating member relative to a horizontal direction parallel with the surface of said substrate;

a gate electrode layer disposed on said second insulating layer opposite to said tips; and an anode electrode electrically connected with said substrate through a part of said substrate and located between said tips of said cathode layer and said gate electrode layer relative to the horizontal direction.

15. A field-emission electronic device according to claim 14, wherein said anode electrode is formed on a part of the surface or in a surface layer of said substrate between said first insulating layer and said second insulating layer relative to the horizontal direction.

16. A field-emission electronic device according to claim 14, wherein said gate electrode layer is located between said tips of said cathode and said anode electrode in a direction orthogonal to the horizontal direction.

17. A field-emission electronic device according to claim 16, wherein said cathode electrode layer is shaped like a sawtooth in plane in the horizontal direction such that each tip corresponds to each top part of the sawtooth-shaped layer and said gate electrode layer corresponds in shape to said cathode electrode layer.

18. A field-emission electronic device according to claim 16, wherein said cathode electrode layer is shaped in such a manner that said tips have top flat projecting portions arranged at regular intervals in plane and said gate electrode layer corresponds in shape to said cathode electrode layer.

19. A field-emission electronic device according to claim 17, wherein each tip includes a first portion made of a metallic material and electrically connected to a body of said cathode layer, a second portion composed of a plurality of successive layers each made of a mixture of the metallic material and one of a carbide, a nitride, an oxide and a boride of the metallic material and laminated on said first portion in the horizontal direction, and a third portion, which corresponds to a top part of each tip that forms a top portion of the sawtooth-shaped cathode, made of one of a carbide, a nitride, an oxide and a boride of the metallic material and laminated on said second portion, composition ratios of carbon, nitrogen, oxygen or boron of the layers in said second portion being gradually increased from the bottom of the layers adjacent to said first portion to the top of the layers adjacent to said third portion.

20. A field-emission electronic device according to claims 16, 17 or 18, wherein each tip projects outwardly from said first insulating layer in parallel with the horizontal direction.

21. A field-emission electronic device according to claims 16, 17 or 18, wherein each tip projects outwardly from said first insulating layer in such a manner as to be inclined toward said gate electrode layer.

22. A field-emission electronic device according to claim 21, wherein each tip is made acute toward the thickness thereof.

* * * * *